US008836217B2

(12) United States Patent
Kato

(10) Patent No.: US 8,836,217 B2
(45) Date of Patent: Sep. 16, 2014

(54) MERCURY-FREE METAL HALIDE LAMP FOR VEHICLE AND METAL HALIDE LAMP DEVICE

(75) Inventor: Satoko Kato, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/128,127

(22) PCT Filed: Feb. 21, 2012

(86) PCT No.: PCT/JP2012/054168

§ 371 (c)(1), (2), (4) Date: Dec. 20, 2013

(87) PCT Pub. No.: WO2012/176493

PCT Pub. Date: Dec. 27, 2012

(65) Prior Publication Data

US 2014/0125224 A1 May 8, 2014

(30) Foreign Application Priority Data

Jun. 23, 2011 (JP) ..... 2011-138993

(51) Int. Cl.

| | |
|---|---|
| ***H01J 17/20*** | (2012.01) |
| ***H01J 61/12*** | (2006.01) |
| ***H01J 61/06*** | (2006.01) |
| ***H01J 5/56*** | (2006.01) |
| ***H01J 61/82*** | (2006.01) |
| ***H01J 61/22*** | (2006.01) |
| ***H01J 61/073*** | (2006.01) |

(52) U.S. Cl.

CPC ..... *H01J 61/22* (2013.01); *H01J 61/125* (2013.01); *H01J 61/06* (2013.01); *H01J 5/56* (2013.01); *H01J 61/825* (2013.01); *H01J 61/0735* (2013.01)

USPC ..... 313/638; 313/631

(58) Field of Classification Search

USPC ..... 362/25, 643, 633, 631, 638

See application file for complete search history.

(56) References Cited

U.S. PATENT DOCUMENTS

| | | | | |
|---|---|---|---|---|
| 6,724,145 | B1 * | 4/2004 | Muto et al. | 313/638 |
| 8,030,847 | B2 | 10/2011 | Haacke et al. | |
| 8,436,539 | B2 | 5/2013 | Haacke et al. | |

(Continued)

FOREIGN PATENT DOCUMENTS

| | | | |
|---|---|---|---|
| JP | 2005-142138 | A | 6/2005 |
| JP | 2006-286384 | A | 10/2006 |

(Continued)

OTHER PUBLICATIONS

Documents from the International Searching Authority received in International Application No. PCT/JP2012/054168 mailed May 29, 2012.

*Primary Examiner* — Anne Hines

(74) *Attorney, Agent, or Firm* — Banner & Witcoff, Ltd.

(57) ABSTRACT

A mercury-free metal halide lamp for a vehicle according to an embodiment includes an airtight vessel 1 provided with a light-emitting part 11 with a discharge space 111 inside, a metal halide 2 and a rare gas sealed in the discharge space 111, and a pair of electrodes 32 disposed so that the tip ends of the respective electrodes 32 face each other in the discharge space 111. The electrodes 32 and the discharge space 111 do not contain thorium. When an electric power supplied to the lamp during a stable lighting period is represented by P (W), a value obtained by adding up the electric power supplied to the lamp during a period between 1 second and 40 seconds after the startup of the lamp is represented by $W_L$ (W), and the diameter of the electrodes 32 is represented by D (mm), P (W) satisfies $20 \leq P \leq 30$ and $W_L/D$ (W/mm) satisfies $4300 \leq W_L/D \leq 7400$.

6 Claims, 4 Drawing Sheets

(56) References Cited

U.S. PATENT DOCUMENTS

| | | | | |
|---|---|---|---|---|
| 2010/0141138 | A1 | 6/2010 | Haacke et al. | |
| 2010/0213807 | A1* | 8/2010 | Haacke et al. | 313/25 |
| 2011/0248628 | A1* | 10/2011 | Werner et al. | 313/570 |
| 2012/0126695 | A1* | 5/2012 | Ramaiah | 313/633 |
| 2013/0038207 | A1* | 2/2013 | Haacke et al. | 313/620 |

FOREIGN PATENT DOCUMENTS

| | | | |
|---|---|---|---|
| JP | 2008-262855 | A | 10/2008 |
| JP | 2010-086742 | A | 4/2010 |
| JP | 2010-521771 | A | 6/2010 |
| JP | 2010-541129 | A | 12/2010 |

* cited by examiner

MERCURY-FREE METAL HALIDE LAMP FOR VEHICLE AND METAL HALIDE LAMP DEVICE

TECHNICAL FIELD

Embodiments of the present invention relate to a mercury-free metal halide lamp to be used for a headlamp of a vehicle such as an automobile and a metal halide lamp device.

BACKGROUND ART

At present, as a headlamp of a vehicle, a short arc type high-pressure discharge metal halide lamp is coming into use. A metal halide lamp has a structure in which a pair of electrodes are disposed facing each other inside an arc tube having a metal halide and a rare gas sealed therein.

In this metal halide lamp, a radioactive material is sometimes used for suppressing flickering. For example, as the metal halide, thorium is sealed in a discharge space or thorium oxide is mixed in an electrode. However, since thorium is a substance of concern, it is desired to avoid using thorium, and thus, it is required to avoid using thorium, in other words, it is required to form a thorium-free lamp. Further, recently, there is a demand for power saving, and a low-power lamp whose lamp power is reduced to 25 W from a conventional lamp power of 35 W is proposed.

In this manner, as the lamp to be used for a vehicle, a low-power and thorium-free lamp is demanded. However, it was found that in such a lamp, not only flickering is liable to occur since thorium is not used, but also electrodes are liable to be deformed.

CITATION LIST

Patent Literature

[PTL 1]
JP-A-2010-86742
[PTL 2]
JP-T-2010-541129
[PTL 3]
JP-A-2010-521771

SUMMARY OF INVENTION

Technical Problem

An object of the invention is to provide a mercury-free metal halide lamp for a vehicle, which is capable of suppressing flickering and electrode deformation, consumes lower power than conventional lamps, and does not contain a radioactive material such as thorium.

Solution to Problem

In order to achieve the above-described object, a mercury-free metal halide lamp according to an embodiment includes an airtight vessel provided with a light-emitting part with a discharge space inside, a metal halide and a rare gas sealed in the discharge space, and a pair of electrodes disposed so that the tip ends of the respective electrodes face each other in the discharge space. The electrodes and the discharge space do not contain thorium, and when an electric power supplied to the lamp during a stable lighting period is represented by P (W), a value obtained by adding up the electric power supplied to the lamp during a period between 1 second and 40 seconds after the startup of the lamp is represented by $W_L$ (W), and the diameter of the electrodes is represented by D (mm), P (W) satisfies $20 \leq P \leq 30$ and $W_L/D$ (W/mm) satisfies $4300 \leq W_L/D \leq 7400$.

DESCRIPTION OF EMBODIMENTS

First Embodiment

Figure 1:
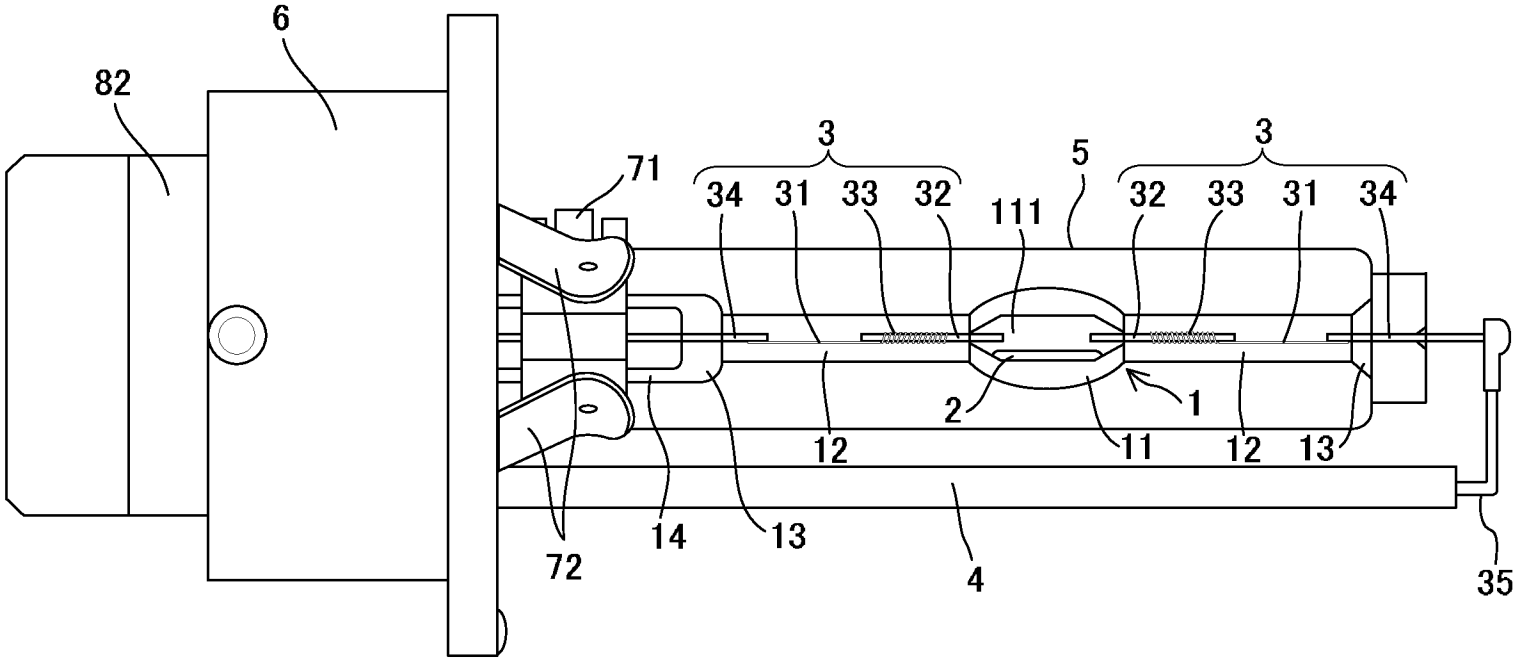
FIG. 1 is a view for explaining a metal halide lamp according to a first embodiment.
Figure 2:
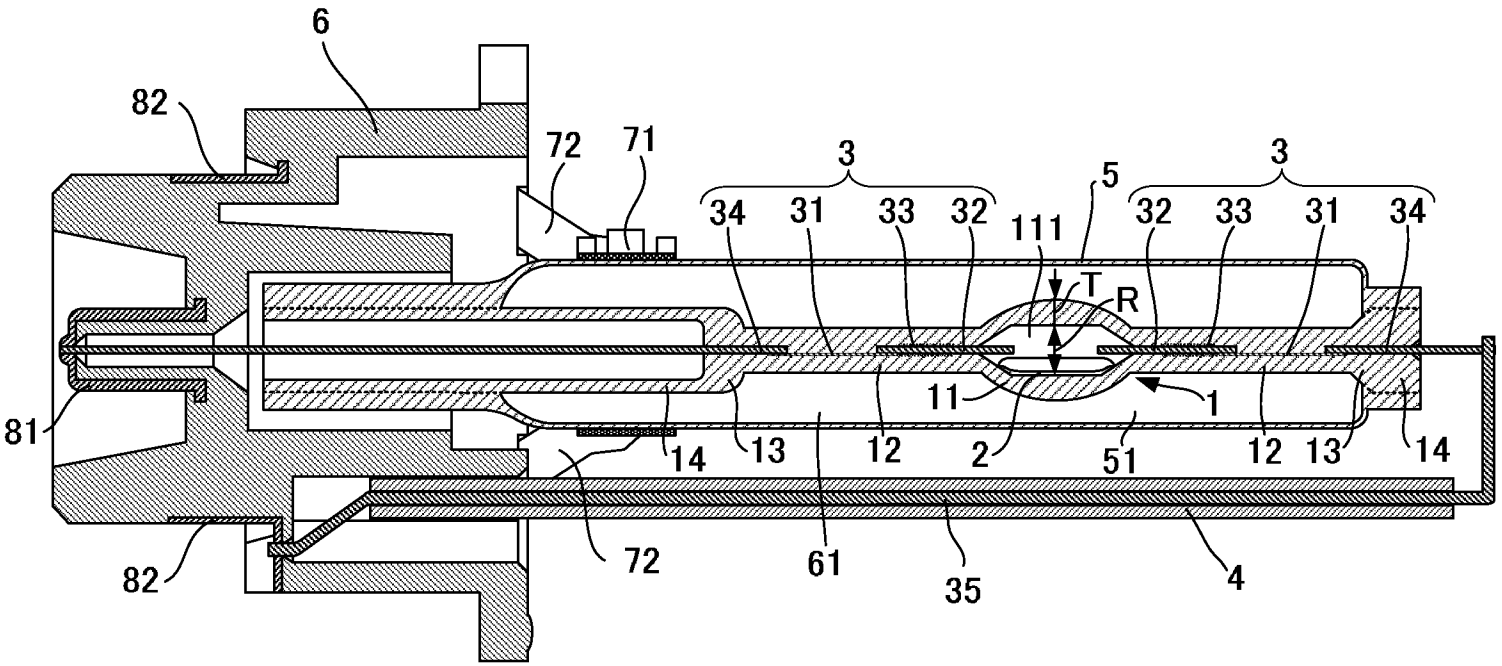
FIG. 2 is a view for explaining a cross section of the metal halide lamp according to the first embodiment.

A first embodiment will be described with reference to FIG. 1 and FIG. 2. FIG. 1 is a view for explaining a metal halide lamp according to a first embodiment of the invention, and FIG. 2 is a view for explaining a cross section of the metal halide lamp according to the first embodiment.

The metal halide lamp according to this embodiment can be used as a light source for a headlamp of an automobile or the like, and includes an inner tube 1 as an airtight vessel. The inner tube 1 has a long and narrow shape, and a substantially oval-shaped light-emitting part 11 is formed near the center of the inner tube. On the both ends of the light-emitting part 11, a plate-shaped seal part 12 formed of a pinch seal is continuously formed, and on the both ends of the resulting body, a cylindrical part 14 is continuously formed through a boundary part 13. This inner tube 1 is desirably formed of, for example, a material having heat resistance and light transmittance such as quartz glass. Further, the seal part 12 may have a cylindrical shape by being formed of a shrink seal.

On the inside of the light-emitting part 11, a discharge space 111 which has a substantially cylindrical central portion and is tapered toward both ends is formed. In the discharge space 111, a metal halide 2 and a rare gas are sealed.

The metal halide 2 is composed of sodium iodide, scandium iodide, zinc iodide, and indium bromide, provided that the metal halide 2 does not contain a halide of thorium or the like which is a radioactive material. The total amount of the sealed metal halide 2 is set to 0.1 mg to 0.3 mg so as to adjust the lamp voltage to a favorable value and so on. Incidentally, the combination of the components of this metal halide 2 is not limited thereto, and a halide of tin or cesium may be added thereto or the like.

As the rare gas, xenon is used. The pressure of this rare gas is from 12 atm to 15 atm. Incidentally, as the rare gas, a mixed gas obtained by combining xenon with neon, argon, krypton, or the like can also be used.

Here, the lamp according to this embodiment is a mercury-free metal halide lamp. The term "mercury-free" as used herein means that mercury is substantially not contained. The meaning of the phrase "mercury is substantially not contained" as used herein is not limited to a case where the amount of sealed mercury is 0 mg, but should be construed to include a case where mercury is sealed in such an amount that almost no mercury is sealed as compared with a conventional metal halide lamp containing mercury, for example, in an amount of less than 2 mg/mL, preferably 1 mg/mL or less.

To each of the seal parts 12 formed on both sides of the light-emitting part 11, an electrode mount 3 is sealed. The electrode mount 3 is formed of a metal foil 31, an electrode 32, a coil 33, and a lead wire 34.

The metal foil 31 is, for example, a thin plate-shaped member composed of molybdenum.

The electrode 32 is, for example, a rod-shaped member composed of tungsten doped with a small amount of aluminum, silicon, and potassium, that is, so-called doped tungsten. One end of the electrode 32 is welded to an end portion of the metal foil 31 on the side of the light-emitting part 11 in such a manner that it is mounted thereon, and the other end of the electrode 32 protrudes into the discharge space 111, and the electrodes 32 are disposed so that the tip ends of the respective electrodes 32 face each other while keeping a predetermined distance therebetween. The diameter D thereof is, for example, 0.25 mm. When the lamp is used for a headlamp of an automobile, it is preferred to position the electrodes 32 such that the distance between the tip ends of the respective electrodes 32 falls within a range of 3.7 mm to 4.4 mm when observation is made through an outer tube 5.

The coil 33 is, for example, a metal wire composed of doped tungsten, and is spirally wound around the axial portion of the electrode 32 sealed to the seal part 12.

The lead wire 34 is, for example, a metal wire composed of molybdenum. One end of the lead wire 34 is connected to an end portion of the metal foil 31 on the side distal to the light-emitting part 11 in such a manner that it is mounted thereon, and the other end of the lead wire 34 extends substantially parallel to the tube axis to the outside of the inner tube 1. To the lead wire 34 extending on the front end side of the lamp, that is, on the side distal to a socket 6, for example, one end of an L-shaped support wire 35 composed of nickel is connected by laser welding. On this support wire 35, for example, a sleeve 4 composed of ceramic is attached to a region extending parallel to the inner tube 1.

On the outside of the thus constructed inner tube 1, a cylindrical outer tube 5 is provided substantially concentrically with the inner tube 1 so as to cover the light-emitting part 11. The connection between the inner tube and the outer tube is made by welding each end portion of the outer tube 5 to the vicinity of the cylindrical part 14 of the inner tube 1. In an enclosed space 51 formed between the inner tube 1 and the outer tube 5, a gas is sealed. As the gas, a gas capable of generating dielectric barrier discharge, for example, one type of gas selected from neon, argon, xenon, and nitrogen, or a mixed gas can be used. The pressure of the gas is desirably 0.3 atm or less, particularly desirably 0.1 atm or less. Incidentally, the outer tube 5 is desirably formed of a material having a thermal expansion coefficient close to that of the inner tube 1 and also having a UV blocking ability, and for example, quartz glass obtained by adding an oxide of titanium, cerium, aluminum, or the like can be used.

To one end of the inner tube 1 to which the outer tube 5 is connected, a socket 6 is connected. Such a connection is made by attaching a metal band 71 to an outer peripheral surface of the outer tube 5, and holding the metal band 71 with metal tongue pieces 72 formed protruding from the socket 6. Further, a bottom terminal 81 is formed on a bottom portion of the socket 6, and a side terminal 82 is formed on a side portion thereof, and the lead wire 34 and the support wire 35 are connected to the bottom terminal 81 and the side terminal 82, respectively.

The thus constructed metal halide lamp is connected to a lighting circuit (not shown in the drawing) such that the bottom terminal 81 is positioned on the higher voltage side, and the side terminal 82 is positioned on the lower voltage side, and is lit such that a lamp power (an electric power supplied to the lamp) P is 55 W during a startup period and 25 W during a stable lighting period.

Figure 3:
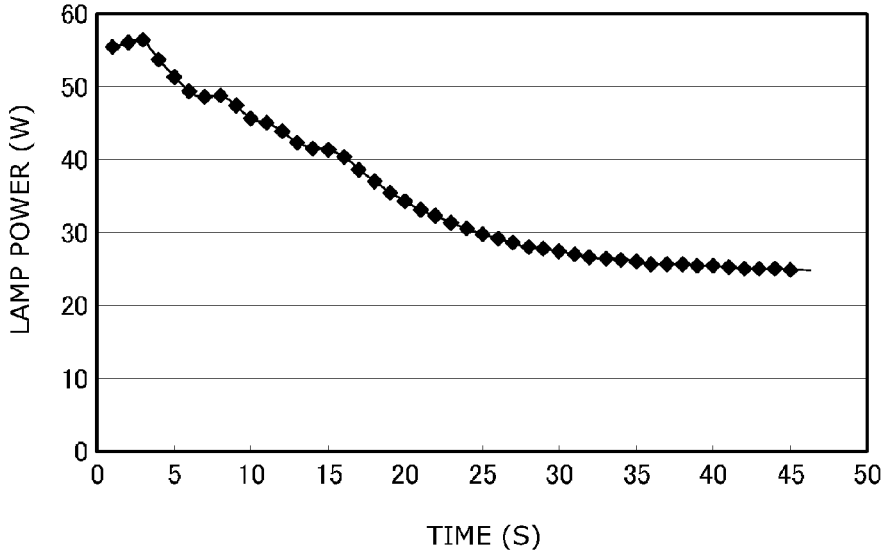
FIG. 3 is a view for explaining a change in lamp power until 50 seconds from the startup of the metal halide lamp according to the first embodiment.

A change in lamp power until 50 seconds from the startup of the metal halide lamp according to this embodiment is shown in FIG. 3. This drawing is a graph obtained by measuring a current and a voltage between the lamp and the lighting circuit and converting the measured current and voltage into an electric power. In this drawing, a value $W_L$ ($=W_{1s}+W_{2s}+W_{3s}+\ldots+W_{40s}$) obtained by adding up the lamp power at 1 second intervals during a period between 1 second and 40 seconds after the startup of the lamp can be calculated to be 1472 W. Incidentally, after the startup of the lamp, a high-voltage pulse of 10 kV or more is applied to the lamp for 1 second, which is a time required for dielectric breakdown, and therefore, the electric power during this period is not taken into account for the calculation of $W_L$. When the diameter D of the electrode is 0.25 mm, $W_L$/D in this lamp is 5888 W/mm. In this lamp, flickering and electrode deformation did not occur, and the electric discharge was stable. On the other hand, it was confirmed that in a lamp in which $W_L$/D was set to 4000 W/mm (Comparative Example 1), flickering occurred, and in a lamp in which $W_L$/D was set to 8000 W/mm (Comparative Example 2), the electrode was largely deformed.

The cause why flickering occurred initially in the lamp of Comparative Example 1 is that a spot which is an arc starting point was not stably formed on the electrode. Comparative Example 1 is a case where the value $W_L$ obtained by adding up the lamp power is small and the diameter D of the electrode is large, and therefore, the temperature of the electrode tends to be low. When the temperature of the electrode is low, even if a spot is formed, the electron discharging ability is low, and therefore, the spot is not stable. Therefore, flickering occurs due to a phenomenon in which the spot moves.

The cause why the electrode was largely deformed in the lamp of Comparative Example 2 is that the electrode was melted. Comparative Example 2 is a case where the value $W_L$ obtained by adding up the lamp power is large and the diameter D of the electrode is small, and therefore, the temperature of the electrode tends to be high. However, a spot is hardly formed when the temperature of the electrode is too high. If this state where a spot is not formed lasts long, a load is imposed on the electrode since the temperature of the electrode is kept high, and therefore, the electrode is thermally deformed.

The present inventor further studied on the basis of these results, and found that there is no problem if a spot is formed within 20 to 30 seconds from the startup of the lamp, but if a spot is not formed even after 40 seconds or more pass from the startup of the lamp, a large load is imposed on the electrode, and in order to stably form a spot, the temperature of the electrode when the lamp power after the startup drops is important. As for the temperature for stably forming a spot, the temperature of the electrode measured by a radiation thermometer at a position apart by a distance equal to the diameter D from the tip end of the electrode is about 2000° C. If the temperature is 1800° C., an unstable spot is liable to be formed, and if the temperature is 2250° C., a spot is hardly formed within 40 seconds.

Figure 4:
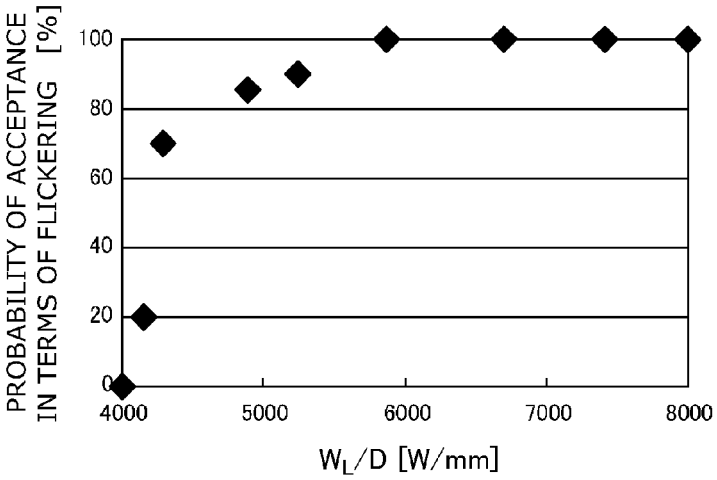
FIG. 4 is a view for explaining $W_L/D$ and the probability of acceptance in terms of flickering.
Figure 5:
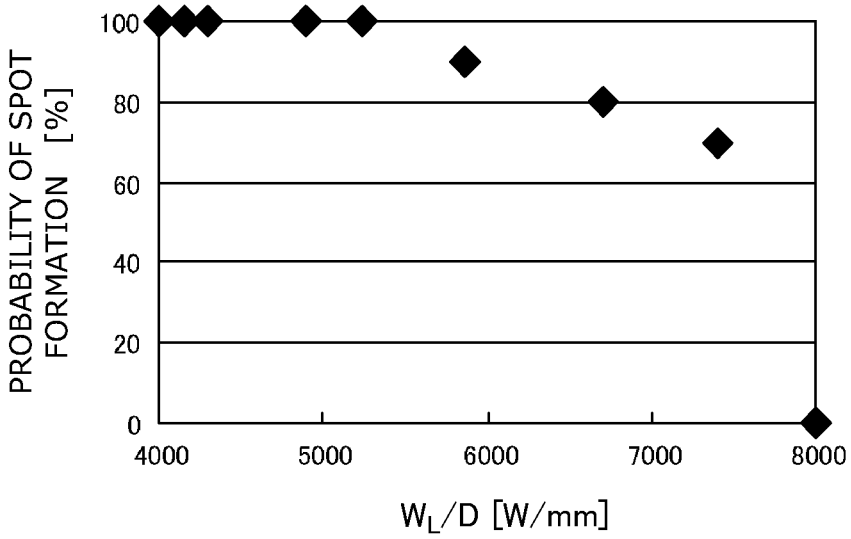
FIG. 5 is a view for explaining $W_L/D$ and the probability of the formation of a spot on an electrode within 40 seconds.

Therefore, a change in lamp power during the startup of the lamp and the temperature of the electrode were considered to be important, and a test was performed with respect to the formation of a spot and the occurrence of flickering when $W_L/D$ which is a relational formula between the value $W_L$ obtained by adding up the lamp power during a period between 1 second and 40 seconds after the startup of the lamp and the diameter D of the electrode was changed. The results are shown in FIG. 4 and FIG. 5. FIG. 4 is a view for explaining $W_L/D$ and the probability of acceptance in terms of flickering, and FIG. 5 is a view for explaining $W_L/D$ and the probability of the formation of a spot on the electrode within 40 seconds. The number of lamps tested is 20.

As found from FIG. 4 and FIG. 5, when $W_L/D$ is 4300 W/mm or more, the occurrence of flickering can be greatly suppressed, and when $W_L/D$ is 7400 W/mm or less, a spot can be formed on the electrode before 40 seconds pass after the startup of the lamp with a high probability, and therefore, the deformation of the electrode can be suppressed. Accordingly, it suffices that $W_L/D$ (W/mm) satisfies $4300 \leq W_L/D \leq 7400$, and if $W_L/D$ (W/mm) satisfies $4900 \leq W_L/D \leq 6700$, a higher effect can be obtained.

Incidentally, $W_L/D$, particularly the value $W_L$ obtained by adding up the lamp power during a period between 1 second and 40 seconds after the startup of the lamp can be adjusted according to the method of dropping the lamp power. That is, as shown in FIG. 3, a higher electric power is supplied during a startup period than during a stable lighting period when the lamp is lit at a rated electric power, however, $W_L$ can be increased or decreased according to the percentage or the timing at which the electric power is decreased. Specifically, when the lamp power is dropped, the temperature of the arc tube is increased to sufficiently evaporate the metal halide, and therefore, the value of $W_L$ is changed by the design of the light-emitting part 11 or the metal halide 2. For example, when the value of $W_L$ is desired to be decreased, the inner diameter, the wall thickness, or the inner volume of the light-emitting part 11 may be decreased, the ratio of the metal halide 2 to be sealed may be changed, or the total amount of the sealed metal halide 2 may be increased. Incidentally, $W_L$ can also be increased or decreased by adjusting the timing or the percentage at which the electric power is decreased by the lighting circuit. However, as the lamp power during a startup period or a stable period, from the viewpoint of the rise of the luminous flux or the life of the lamp, the lamp power is desirably set within a range of 50 W to 60 W during a startup period and within a range of 20 W to 30 W during a stable period. Incidentally, $W_L$ is desirably adjusted within a range of 1200 W to 1600 W, and D is desirably adjusted within a range of 0.22 mm to 0.30 mm. The inner diameter R in a substantially central portion in the tube axial direction of the light-emitting part 1 is desirably from 1.5 to 2.3 mm, the wall thickness T in a substantially central portion in the tube axial direction of the light-emitting part 1 is desirably from 1.2 to 1.8 mm, the inner volume of the light-emitting part 1 is desirably from 15 to 23 $mm^3$, and the total amount of the sealed metal halide 2 is desirably from 0.05 to 0.25 mg (0.0025 to 0.0125 $mg/mm^3$). The inner diameter R of the light-emitting part 1 is most preferably from 1.8 to 2.2 mm, the wall thickness T of the light-emitting part 1 is most preferably from 1.4 to 1.7 mm, the inner volume of the light-emitting part 1 is most preferably from 17 to 21 $mm^3$, and the total amount of the sealed metal halide 2 is most preferably from 0.10 to 0.20 mg (0.005 to 0.010 $mg/mm^3$).

In the first embodiment, when a value obtained by adding up the electric power supplied to the lamp during a period between 1 second and 40 seconds after the startup of the lamp is represented by $W_L$ (W), and the diameter of the electrode 32 is represented by D (mm), by setting $W_L/D$ (W/mm) to satisfy $4300 \leq W_L/D \leq 7400$, preferably $4900 \leq W_L/D \leq 6700$, even if the lamp does not contain mercury, the electrode 32 and the discharge space 111 in the lamp do not contain thorium, and the lamp is lit at a low electric power of 20 W to 30 W during a stable lighting period, flickering and electrode deformation can be suppressed.

The invention is not limited to the above-described embodiment, and various modifications can be made.

For example, the metal halide lamp may be a lamp integrally formed with an ignition circuit, a lamp integrally formed with an ignition circuit and a ballast circuit, or the like.

Figure 6:
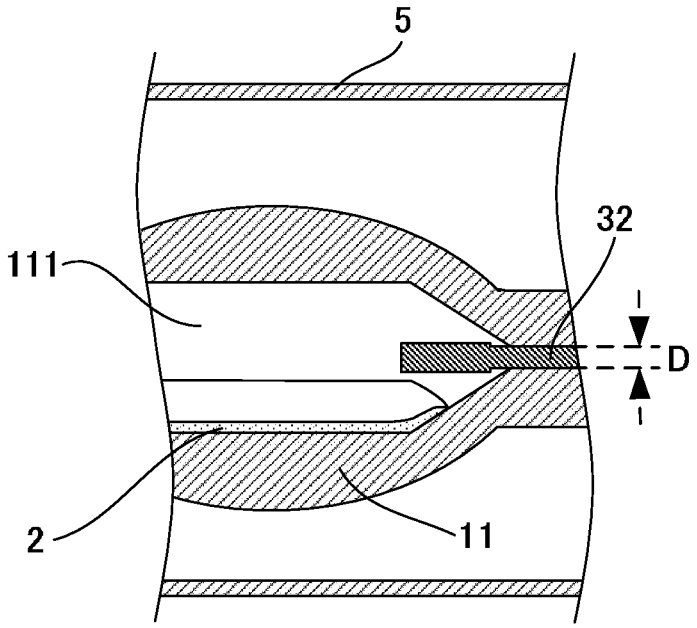
FIG. 6 is a view for explaining another shape of an electrode.

The shape of the electrode 32 may be, for example, as shown in FIG. 6, a stepped shape in which the diameter of the tip end is made larger than that of the base end, a shape with a spherical tip end having a large diameter, or a shape such that the diameter of one electrode is different from that of the other electrode. Incidentally, when the electrode has a shape in which the diameter of the tip end is different from that of the base end as shown in FIG. 6, the diameter of the electrode on the base end side, that is, the diameter of an axial portion is represented by D (mm). Further, the material of the electrode may be pure tungsten, rhenium tungsten, or the like, in other words, the material may be any as long as the electrode does not contain a radioactive material such as thorium oxide.

While certain embodiments of this invention have been described, these embodiments have been presented by way of example only, and are not intended to limit the scope of the invention. The novel embodiments described herein may be embodied in a variety of other forms, and various omissions, substitutions, and changes may be made without departing from the spirit of the invention. These embodiments and modifications thereof are included in the scope and spirit of the invention, and also included in the invention described in the scope of claims and the scope of equivalents thereof.

The invention claimed is:

1. A mercury-free metal halide lamp for a vehicle, comprising: an airtight vessel provided with a light-emitting part with a discharge space inside; a metal halide and a rare gas sealed in the discharge space; and a pair of electrodes disposed so that the tip ends of the respective electrodes face each other in the discharge space, wherein the electrodes and the discharge space do not contain thorium, and when an electric power supplied to the lamp during a stable lighting period is represented by P (W), a value obtained by adding up the electric power supplied to the lamp during a period between 1 second and 40 seconds after the startup of the lamp is represented by $W_L$ (W), and the diameter of the electrodes is represented by D (mm), P (W) satisfies $20 \leq P \leq 30$ and $W_L/D$ (W/mm) satisfies $4300 \leq W_L/D \leq 7400$.

2. The lamp according to claim 1, wherein $W_L/D$ (W/mm) satisfies $4900 \leq W_L/D \leq 6700$.

3. The lamp according to claim 1, wherein $W_L$ is from 1200 W to 1600 W, and D is from 0.22 mm to 0.30 mm.

4. The lamp according to claim 1, wherein the inner diameter R of the light-emitting part is from 1.5 to 2.3 mm, the wall thickness T of the light-emitting part is from 1.2 to 1.8 mm, the inner volume of the light-emitting part is from 15 to 23 $mm^3$, and the total amount of the sealed metal halide is from 0.05 to 0.25 mg.

5. The lamp according to claim 1, wherein the inner diameter R of the light-emitting part is from 1.8 to 2.2 mm, the wall thickness T of the light-emitting part is from 1.4 to 1.7 mm, the inner volume of the light-emitting part is from 17 to 21 $mm^3$, and the total amount of the sealed metal halide is from 0.10 to 0.20 mg.

6. A metal halide lamp device, comprising: the mercury-free metal halide lamp for a vehicle according to claim 1; and a lighting circuit which supplies an electric power of 50 to 60 W during a startup period and supplies an electric power of 20 to 30 W during a stable period to the mercury-free metal halide lamp for a vehicle.

* * * * *